US008505648B2

(12) United States Patent
Elger

(10) Patent No.: US 8,505,648 B2
(45) Date of Patent: Aug. 13, 2013

(54) DRIVE ASSEMBLY FOR A POWER TOOL

(75) Inventor: William A. Elger, West Bend, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 390 days.

(21) Appl. No.: 12/991,182

(22) PCT Filed: May 7, 2009

(86) PCT No.: PCT/US2009/043152

§ 371 (c)(1),
(2), (4) Date: Nov. 5, 2010

(87) PCT Pub. No.: WO2009/137684

PCT Pub. Date: Nov. 12, 2009

(65) Prior Publication Data

US 2011/0048751 A1 Mar. 3, 2011

Related U.S. Application Data

(60) Provisional application No. 61/051,032, filed on May 7, 2008.

(51) Int. Cl.
*B25D 17/06* (2006.01)

(52) U.S. Cl.
USPC ..... 173/93.5; 173/93

(58) Field of Classification Search
USPC ..... 173/93.5, 93.6, 216, 217, 114, 176, 173/93, 94
See application file for complete search history.

(56) References Cited

U.S. PATENT DOCUMENTS

| | | | | |
|---|---|---|---|---|
| 2,514,914 | A | 7/1950 | Van Sittert | |
| 2,910,901 | A | 11/1959 | Ryd | |
| 3,428,137 | A | 2/1969 | Schaedler et al. | |
| 3,605,914 | A | 9/1971 | Kramer | |
| 3,610,344 | A | 10/1971 | Schoeps et al. | |
| 3,874,460 | A | 4/1975 | Schmid et al. | |
| 4,347,902 | A * | 9/1982 | Wallace et al. | 173/93.5 |
| 4,446,931 | A | 5/1984 | Bleicher et al. | |
| 4,557,337 | A * | 12/1985 | Shibata | 173/93.5 |
| 5,595,251 | A * | 1/1997 | Cook, Jr. | 173/178 |

(Continued)

FOREIGN PATENT DOCUMENTS

WO 99/17909 4/1999

OTHER PUBLICATIONS

PCT/US2009/043152 International Search Report and Written Opinion.
Dewalt Parts List for DW292 Type 1; Copyright 2005; pp. 1-3.

(Continued)

*Primary Examiner* — Scott A. Smith
(74) *Attorney, Agent, or Firm* — Michael Best & Friedrich LLP

(57) ABSTRACT

A drive assembly for an impact wrench includes a tool element for working on a workpiece. The drive assembly also includes a ram rotatable about a central axis. The ram includes a ram lug spaced from the central axis. The ram lug has at least one drive surface. The drive assembly further includes an anvil having an anvil lug with at least one driven surface engageable with the drive surface of the ram lug to drive the anvil. The anvil is connectable to the tool element to rotatably drive the tool element. At least one of the drive surface and the driven surface includes an involute profile.

20 Claims, 7 Drawing Sheets

(56) References Cited

U.S. PATENT DOCUMENTS

| | | | | |
|---|---|---|---|---|
| 5,853,052 | A * | 12/1998 | Baiden et al. | 173/15 |
| 5,906,244 | A | 5/1999 | Thompson et al. | |
| 6,003,618 | A | 12/1999 | Wallace | |
| 6,047,779 | A | 4/2000 | Wallace | |
| 6,070,674 | A * | 6/2000 | Williamson et al. | 173/1 |
| 6,491,111 | B1 * | 12/2002 | Livingston et al. | 173/93.5 |
| 6,581,697 | B1 | 6/2003 | Giardino | |
| 6,889,778 | B2 * | 5/2005 | Colangelo et al. | 173/93.5 |
| 7,140,282 | B1 | 11/2006 | Chang | |
| 7,331,404 | B2 | 2/2008 | Pusateri | |
| 7,562,720 | B2 * | 7/2009 | Seith et al. | 173/176 |
| 8,297,373 | B2 * | 10/2012 | Elger et al. | 173/94 |
| 2006/0266170 | A1 | 11/2006 | Chang | |
| 2008/0099217 | A1 | 5/2008 | Seith et al. | |

OTHER PUBLICATIONS

Makita Parts List for TW0350; Aug. 18, 2010; pp. 1-2.

Hitachi Power Tools—Electric Tool Parts List for Model WR16SA; Dec. 30, 2004; pp. 1-6.

Hitachi Instruction Manual for Impact Wrench Model WR16SA; pp. 1-48.

Makita Instruction Manual for Impact Wrench Model TW0350; pp. 1-13.

Milwaukee Service Parts List for Impact Wrench Model 9070-20; Jul. 2002, pp. 1-2.

Milwaukee Operator's Manual for Impact Wrench Model Nos. 9070-20, 9071-20, 9072-20, 9072-22, 9075-20, 9092-20, 9096-20; May 2007; pp. 1-36.

Milwaukee Service Parts List for Impact Wrench Model 9079-20; Jul. 2003; pp. 1.

Milwaukee Operator's Manual for Impact Wrench Model Nos. 9078-20, 9079-20, 9098-23, 9099-20; Sep. 2007; pp. 1-28.

* cited by examiner

DRIVE ASSEMBLY FOR A POWER TOOL

CROSS-REFERENCE TO RELATED APPLICATIONS

This application claims priority to U.S. Provisional Patent Application Ser. No. 61/051,032 filed on May 7, 2008, the entire contents of which is incorporated herein by reference.

FIELD OF THE INVENTION

The present invention relates to tools, and more particularly to power tools.

BACKGROUND OF THE INVENTION

Drive assemblies are typically employed in power tools (e.g., electrically-operated power tools, pneumatic power tools, etc.) to transfer torque from a motor to a tool element to perform work on a workpiece. Particularly, impact wrenches utilize drive assemblies to convert continuous rotational motion of an output shaft of the motor to a striking rotational force, or intermittent applications of torque, to the tool element and workpiece. As such, impact wrenches are typically used to loosen or remove stuck fasteners (e.g., an automobile lug nut on an axle stud) that are otherwise not removable or very difficult to remove using hand tools. Such drive assemblies typically include a ram having at least one drive surface, and an anvil having at least one, typically flat driven surface oriented substantially normal to a longitudinal axis of the anvil.

The outer corner of the driven surface is typically rounded with a relatively small radius, providing a relatively sharp transition from the driven surface to an adjacent end surface of the anvil. With such a flat driven surface, imperfections in the form, size, and symmetry of the anvil may yield uneven contact between the ram and the anvil during operation of the impact wrench, potentially reducing the efficiency of the impact wrench and/or accelerating wear between the ram and the anvil.

Depending upon the size and configuration of the impact wrench, a relatively large amount of torque may be transferred through the drive assembly to the tool element and workpiece. As a result, relatively high contact stresses often occur at the outer corner of the driven surface during operation of the impact wrench.

SUMMARY OF THE INVENTION

The invention provides, in one aspect, a drive assembly for an impact wrench. The impact wrench includes a tool element for working on a workpiece. The drive assembly includes a ram rotatable about a central axis. The ram includes a ram lug spaced from the central axis. The ram lug has at least one drive surface. The drive assembly also includes an anvil having an anvil lug with at least one driven surface engageable with the drive surface of the ram lug to drive the anvil. The anvil is connectable to the tool element to rotatably drive the tool element. At least one of the drive surface and the driven surface includes an involute profile.

The invention provides, in another aspect, an impact wrench operable with a tool element for working on a workpiece. The impact wrench includes a housing, a motor supported by the housing, and a ram rotatable about a central axis in response to torque received from the motor. The ram includes a ram lug spaced from the central axis. The ram lug has at least one drive surface. The impact wrench also includes an anvil having an anvil lug with at least one driven surface engageable with the drive surface of the ram lug to drive the anvil. The anvil is connectable to the tool element to rotatably drive the tool element. At least one of the drive surface and the driven surface includes an involute profile.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
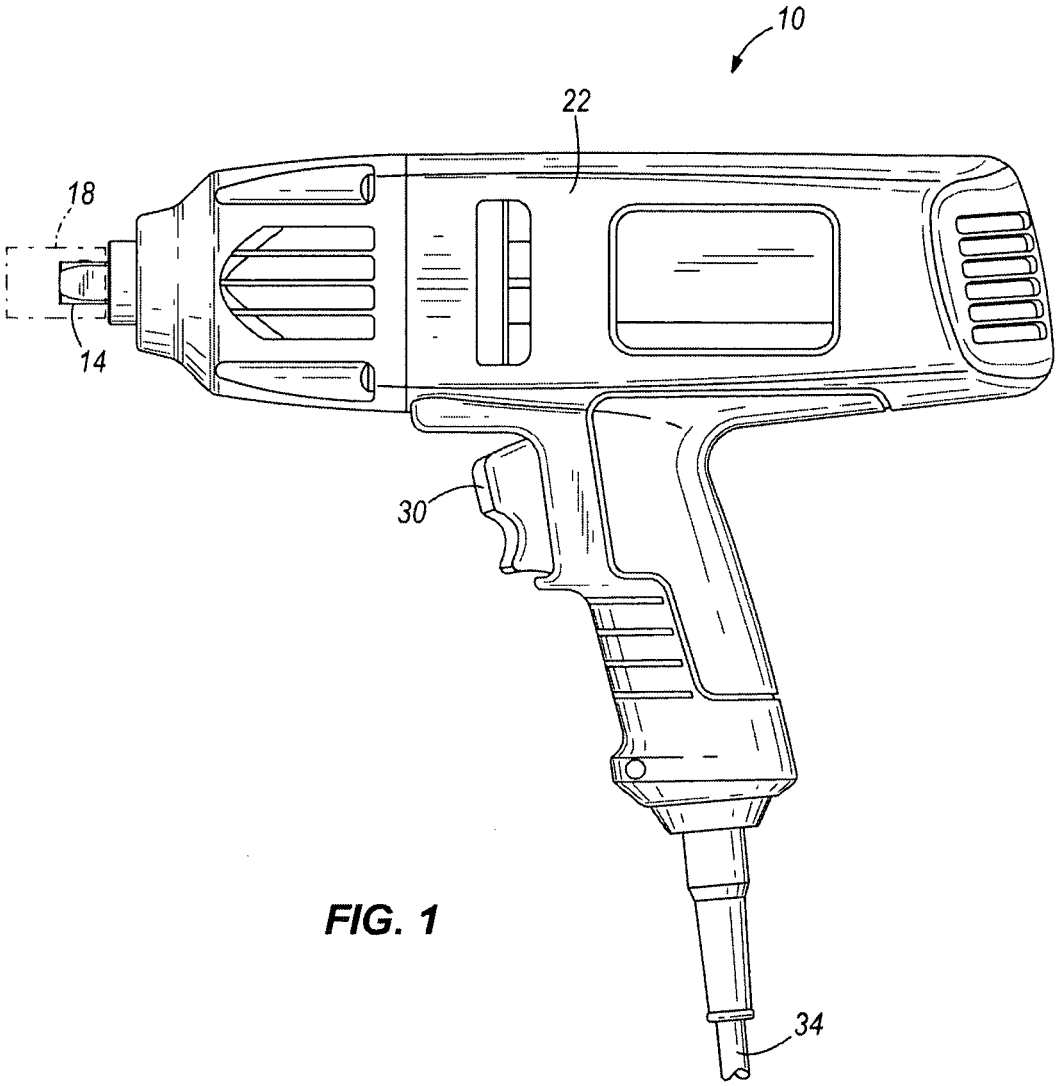
FIG. 1 is a side view of an impact wrench incorporating a drive assembly of the present invention.
Figure 2:
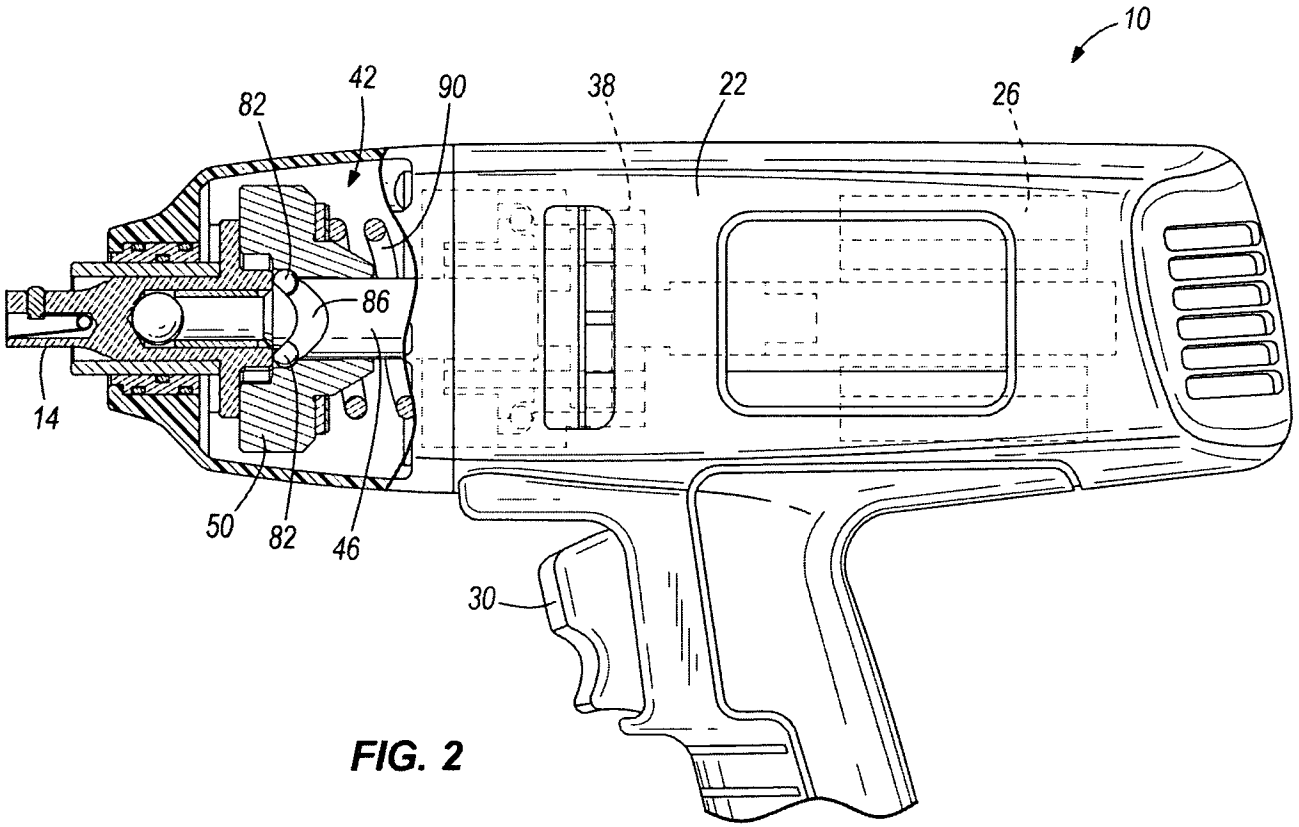
FIG. 2 is a partial cutaway view of the impact wrench of FIG. 1, illustrating the drive assembly in cross-section.

FIG. 1 illustrates an impact wrench 10 including an anvil 14 and a tool element 18 coupled to the anvil 14. Although the tool element 18 is schematically illustrated, the tool element 18 may include a socket configured to engage the head of the fastener (e.g., a bolt). Alternatively, the tool element 18 may include any of a number of different configurations (e.g., an auger or a drill bit) to perform work on a workpiece. With reference to FIGS. 1 and 2, the impact wrench 10 includes a housing 22 and a reversible electric motor 26 coupled to the anvil 14 to provide torque to the anvil 14 and the tool element 18. The impact wrench 10 also includes a switch (e.g., trigger switch 30) supported by the housing 22 and a power cord 34 extending from the housing 22 for electrically connecting the switch 30 and the motor 26 to a source of AC power. Alternatively, the impact wrench 10 may include a battery, and the motor 26 may be configured to operate on DC power provided by the battery. As a further alternative, the impact wrench 10 may be configured to operate using a different power source (e.g., a pneumatic or hydraulic power source, etc.) besides electricity.

With reference to FIG. 2, the impact wrench 10 also includes a gear assembly 38 coupled to an output of the motor 26 and a drive assembly 42 coupled to an output of the gear assembly 38. The gear assembly 38 may be configured in any of a number of different ways to provide a speed reduction between the output of the motor 26 and an input of the drive assembly 42. The drive assembly 42, of which the anvil 14 may be considered a component, is configured to convert the constant rotational force or torque provided by the gear assembly 38 to a striking rotational force or intermittent applications of torque to the tool element 18. In the illustrated construction of the impact wrench 10, the drive assembly 42 includes a camshaft 46 coupled to and driven by the gear assembly 38, a ram 50 supported on and axially slidable relative to the camshaft 46, and the anvil 14. U.S. Pat. No. 6,733,414, the entire contents of which is incorporated herein by reference, discloses in detail example configurations of the gear assembly 38, and the structure and operation of a camshaft and a ram similar to the camshaft 46 and the ram 50. As will be described in greater detail below, however, portions of the ram 50 (e.g., ram lugs 54) are structurally different than the ram disclosed in U.S. Pat. No. 6,733,414.

Figure 3:
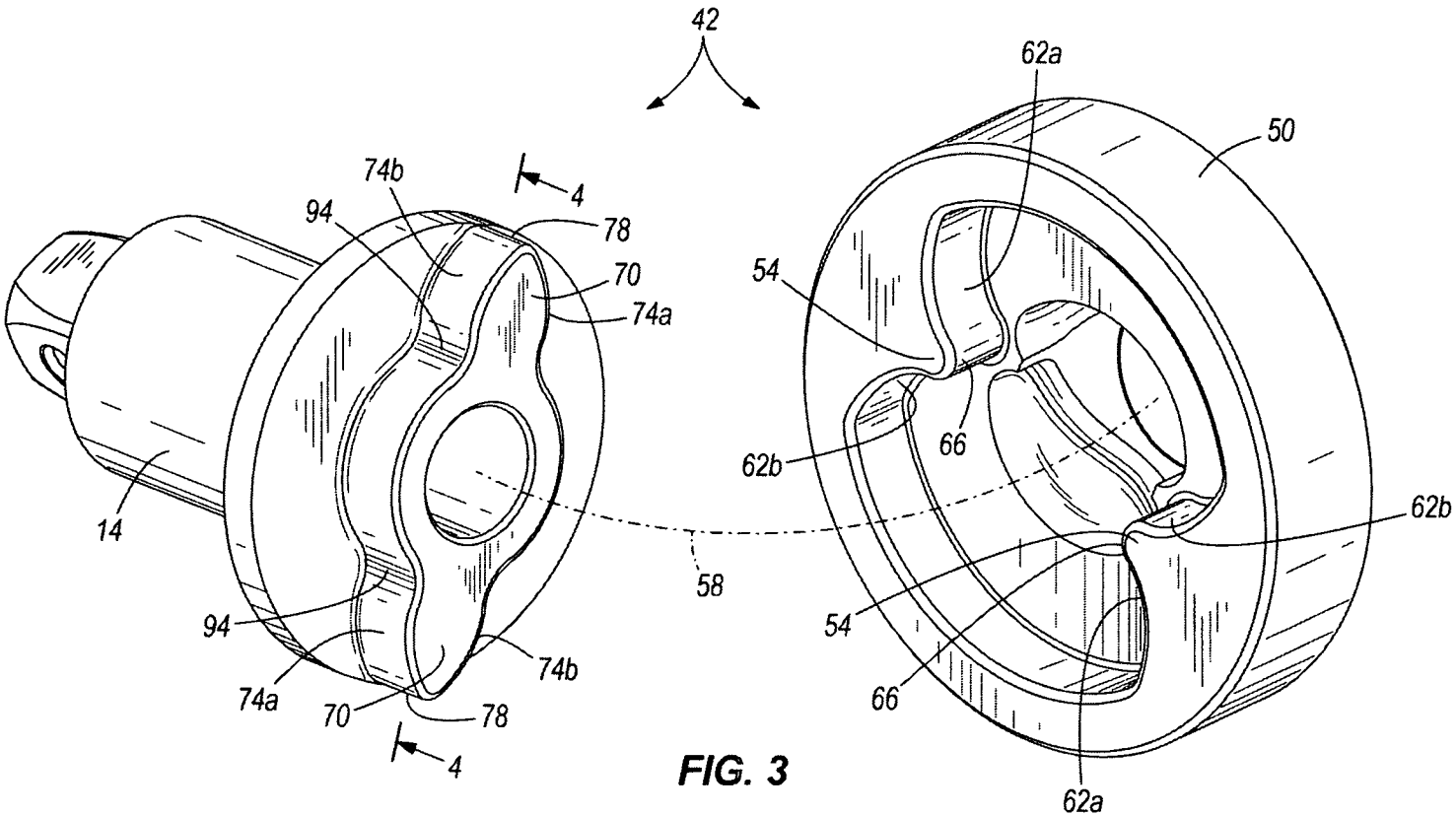
FIG. 3 is an exploded perspective view of a portion of the drive assembly of FIG. 2.

With reference to FIG. 3, the ram 50 includes dual ram lugs 54, each of which is spaced from a rotational axis 58 of the ram 50 and the anvil 14. Each of the ram lugs 54 includes a first drive surface 62*a*, a second drive surface 62*b* on an opposite side of the ram lug 54 as the first drive surface 62*a*, and a curved or arcuate distal end 66 interconnecting the first and second drive surfaces 62*a*, 62*b*. As will be described in greater detail below, the respective first drive surfaces 62*a* of the ram lugs 54 may be employed during clockwise rotation, or a forward direction of rotation of the ram 50 and the anvil 14, while the respective second drive surfaces 62*b* of the ram lugs 54 may be employed during counter-clockwise rotation, or a reverse direction of rotation of the ram 50 and the anvil 14. Alternatively, the ram 50 may include only a single ram lug 54, or more than two ram lugs 54. Furthermore, in a construction of the impact wrench incorporating a non-reversible motor, each of the drive lugs need only include a single drive surface.

With continued reference to FIG. 3, the anvil 14 includes dual anvil lugs 70, each of which is spaced from the rotational axis 58 of the ram 50 and the anvil 14. Each of the anvil lugs 70 includes a first driven surface 74*a*, a second driven surface 74*b* on an opposite side of the anvil lug 70 as the first driven surface 74*a*, and a curved or arcuate distal end 78 interconnecting the first and second driven surfaces 74*a*, 74*b*. As mentioned above, the respective first driven surfaces 74*a* of the anvil lugs 70 may be employed during clockwise rotation, or a forward direction of rotation of the ram 50 and the anvil 14, while the respective second driven surfaces 74*b* of the anvil lugs 70 may be employed during counterclockwise rotation, or a reverse direction of rotation of the ram 50 and the anvil 14. Alternatively, the anvil 14 may include only a single anvil lug 70, or more than two anvil lugs. Furthermore, in a construction of the impact wrench incorporating a non-reversible motor, each of the driven lugs need only include a single driven surface.

Figure 4:
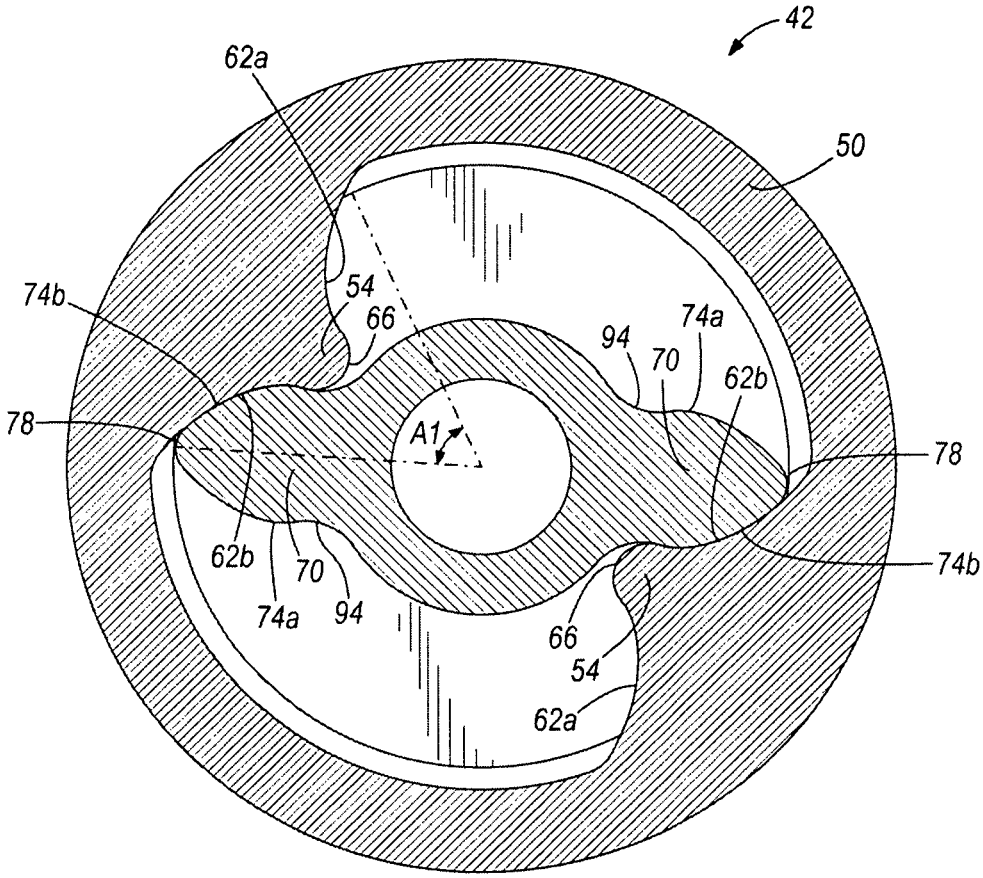
FIG. 4 is an assembled, cross-sectional view of the portion of the drive assembly of FIG. 2, taken along line 4-4 in FIG. 3.

With reference to FIGS. 3 and 4, each of the drive surfaces 62*a*, 62*b* of the ram lugs 54 is defined by a concave curve such that hypothetical lines drawn normal to the drive surface 62*a* or 62*b*, through neighboring points on the same drive surface, converge in a direction moving away from the drive surface. Similarly, each of the driven surfaces 74*a*, 74*b* of the anvil lugs 70 is defined by a convex curve such that hypothetical lines drawn normal to the driven surface 74*a* or 74*b*, through neighboring points on the same driven surface, diverge in a direction moving away from the driven surface. The curved surfaces 62*a*, 74*a* are complementary to each other such that the surfaces 62*a*, 74*a* are engageable over substantially their entire lengths at a given instant. Likewise, the curved surfaces 62*b*, 74*b* are complementary to each other such that the surfaces 62*b*, 74*b* are engageable over substantially their entire lengths at a given instant.

Figure 6:
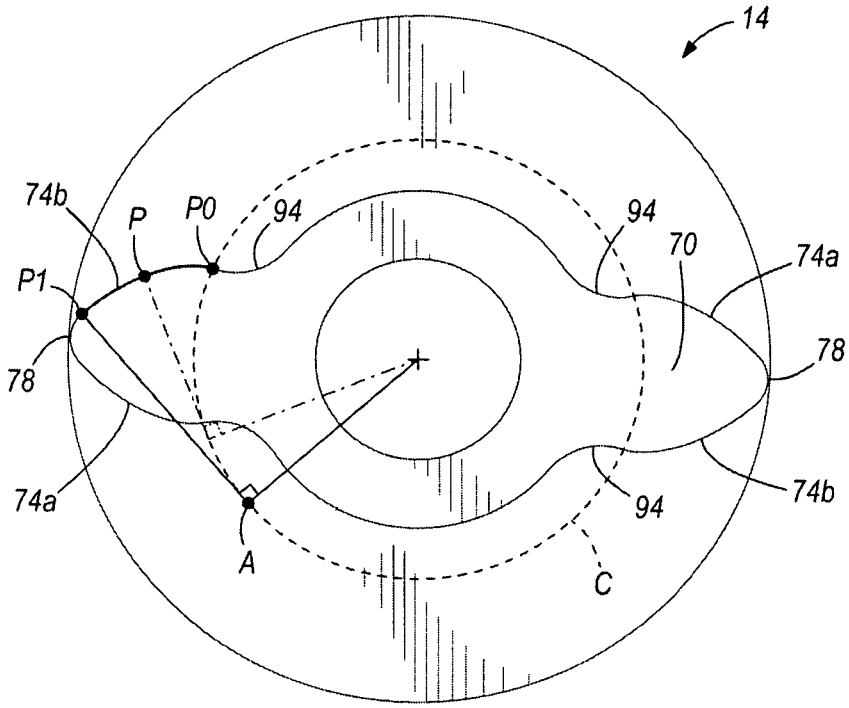
FIG. 6 is a rear view of an anvil of the drive assembly of FIG. 2, illustrating the derivation of an involute profile on a driven surface of the anvil.
Figure 7:
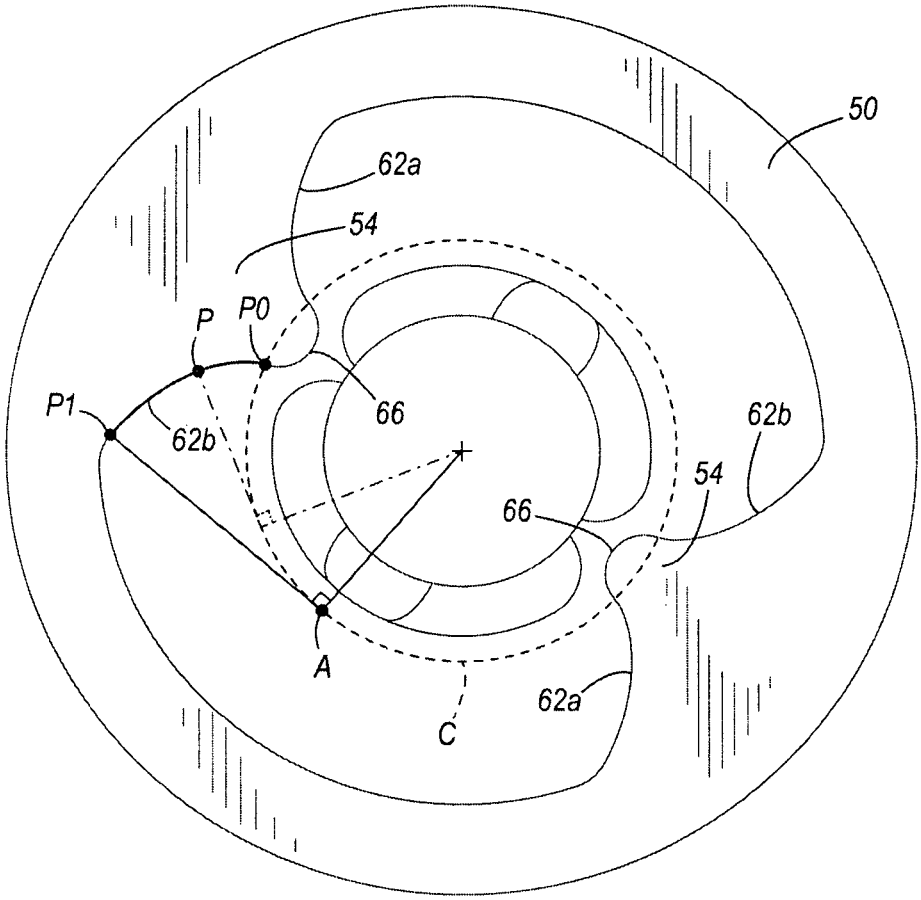
FIG. 7 is a front view of a ram of the drive assembly of FIG. 2, illustrating the derivation of an involute profile on a drive surface of the ram.

In the illustrated construction of the drive assembly 42, each of the curved drive surfaces 62*a*, 62*b* of the ram lugs 54 and each of the curved driven surfaces 74*a*, 74*b* of the anvil lugs defines an involute profile. More particularly, the involute profile of each of the driven surfaces 74*a*, 74*b* of the anvil lugs 70, and each of the drive surfaces 62*a*, 62*b* of ram lugs 54, is based upon or derived from a hypothetical base cylinder centered on the axis 58 (e.g., hypothetical base cylinder C; FIGS. 6 and 7). With reference to FIG. 6, the curvature of the driven surface 74*b* is traced by a point P (from P0 to P1) on an imaginary, taut thread or cord as it is unwound from the hypothetical base cylinder C in a counterclockwise direction, thereby generating the involute profile of the driven surface 74*b*. The involute profile of the driven surface 74*a* is generated in a similar manner, except the imaginary, taut thread or cord is unwound from the hypothetical base cylinder C in a clockwise direction from the point of view of FIG. 6. The anvil 14 also includes also includes an arcuate surface or fillet 94 adjacent each of the driven surfaces 74*a*, 74*b* at the base of each anvil lug 70 to reduce the stress concentration at the base of the anvil lugs 70 (see also FIGS. 3 and 4).

With reference to FIG. 7, the curvature of the drive surface 62*b* is traced by the same point P (from P0 to P1) on the imaginary, taut thread or cord as it is unwound from the same hypothetical base cylinder C in a counterclockwise direction, thereby generating the involute profile of the drive surface 62*b*. The involute profile of the drive surface 62*a* is generated in a similar manner, except the imaginary, taut thread or cord is unwound from the hypothetical base cylinder C in a clockwise direction from the point of view of FIG. 7. The line A-P1 (FIGS. 6 and 7) is representative of the unwound length of the imaginary thread or cord, which is normal to a radius of the base cylinder C and the involute at the point P1. Although the unwound length of the imaginary thread or cord continuously increases, it remains normal to the radius of the base cylinder C and the involute throughout the unwinding process.

As shown in FIG. 4, at least a portion of the arcuate distal end 66 of each ram lug 54 is engageable with one of the fillets 94 on each anvil lug 70 when the drive surface 62*b* is engaged with the driven surface 74*b*. Alternatively, the ram lugs 54 may only engage the anvil lugs 70 along the respective surfaces 62*a*, 74*a* or the surfaces 62*b*, 74*b*.

The involute profile of each of the drive surfaces 62*a*, 62*b* and the driven surfaces 74*a*, 74*b*, among other things, facilitates a substantially uniform distribution of load across the entire length of each drive surface 62*a*, 62*b* when engaged to the respective driven surface 74*a*, 74*b*. Consequently, localized contact stresses between the ram lugs 54 and the anvil lugs 70 are substantially reduced during operation of the impact wrench 10, thereby reducing wear of the ram 50 and anvil 14, and increasing the useful life of the ram 50 and anvil 14. In addition, because contact between the respective drive surfaces 62*a*, 62*b* and the driven surfaces 74*a*, 74*b* is substantially spread across the entire lengths of the respective drive surfaces 62*a*, 62*b* and the driven surfaces 74*a*, 74*b*, the overall mechanical efficiency of the impact wrench 10 is increased. Contact between the involute drive surfaces 62*a*, 62*b* and the involute driven surfaces 74*a*, 74*b* will have a "centering" effect on the anvil 14 during operation of the impact wrench 10 (i.e., the forces exerted by the ram 50 on the anvil 14 tend to align the anvil 14 with the rotational axis 58), thereby further increasing the efficiency of the impact wrench 10.

In operation of the impact wrench 10 in a forward or clockwise direction of rotation, an operator depresses the switch 30 to electrically connect the motor 26 with a source of power to operate the motor 26 and drive the gear assembly 38 and the camshaft 46. As the ram 50 co-rotates with the camshaft 46, the drive surfaces 62*a* of the ram lugs 54 engage, respectively, the driven surfaces 74*a* of the anvil lugs 70 to provide an impact and to rotatably drive the anvil 14 and the tool element 18 in the selected clockwise or forward direction. After each impact, the ram 50 moves or slides rearwardly along the camshaft 46, away from the anvil 14, so that the ram lugs 54 disengage the anvil lugs 70. As the ram 50 moves rearwardly, cam balls 82 (FIG. 2) situated in respective cam grooves 86 in the camshaft 46 move rearwardly in the cam grooves 86. A spring 90 stores some of the rearward energy of the ram 50 to provide a return mechanism for the ram 50. After the ram lugs 54 disengage the respective anvil lugs 70, the ram 50 continues to rotate and moves or slides forwardly, toward the anvil 14, as the spring 90 releases its stored energy, until the drive surfaces 62*a* of the ram lugs 54 re-engage the driven surfaces 74*a* of the anvil lugs 70 to cause another impact. In operation of the impact wrench in a reverse or counter-clockwise direction of rotation, the drive surfaces 62*b* of the ram lugs 54 engage the respective driven surfaces 74*b* of the anvil lugs 70 (FIG. 4), in a similar manner to that described above with reference to the forward or clockwise direction of rotation of the impact wrench 10.

In addition to reducing the localized contact stresses between the ram lugs 54 and the anvil lugs 70, incorporating the involute profiles on the drive surfaces 62*a*, 62*b* on the ram lugs 54 and the involute profiles on the driven surfaces 74*a*, 74*b* on the anvil lugs 70 also enhances the smoothness of operation of the impact wrench 10 by reducing a timing angle A1 during which the ram 50 is retracted on the camshaft 46 and the ram lugs 54 are passing over the anvil lugs 70. With continued reference to FIG. 4, the timing angle A1 is about 60 degrees. In other words, about 60 degrees of rotation of the ram 50 is required, when in its retracted position along the camshaft 46 and rotating over the anvil 14, before the ram 50 may be moved toward the anvil 14 by the spring 90 in preparation for the next strike or impact between the ram lugs 54 and the anvil lugs 70. More particularly, using the orientation of the ram 50 relative to the anvil 14 shown in FIG. 4 as a reference, in which the drive surface 62*b* and driven surface 74*b* are engaged, the ram 50 traverses an angle A1 of about 60 degrees in a counterclockwise direction while in its retracted position along the camshaft 46 before the ram 50 is allowed to resume its extended position to position the drive surface 62*a* adjacent the driven surface 74*a*. Alternatively, the anvil lugs 70 and/or the ram lugs 54 may be sized having a reduced thickness from that shown in FIG. 4 to further reduce the timing angle A1.

Figure 5:
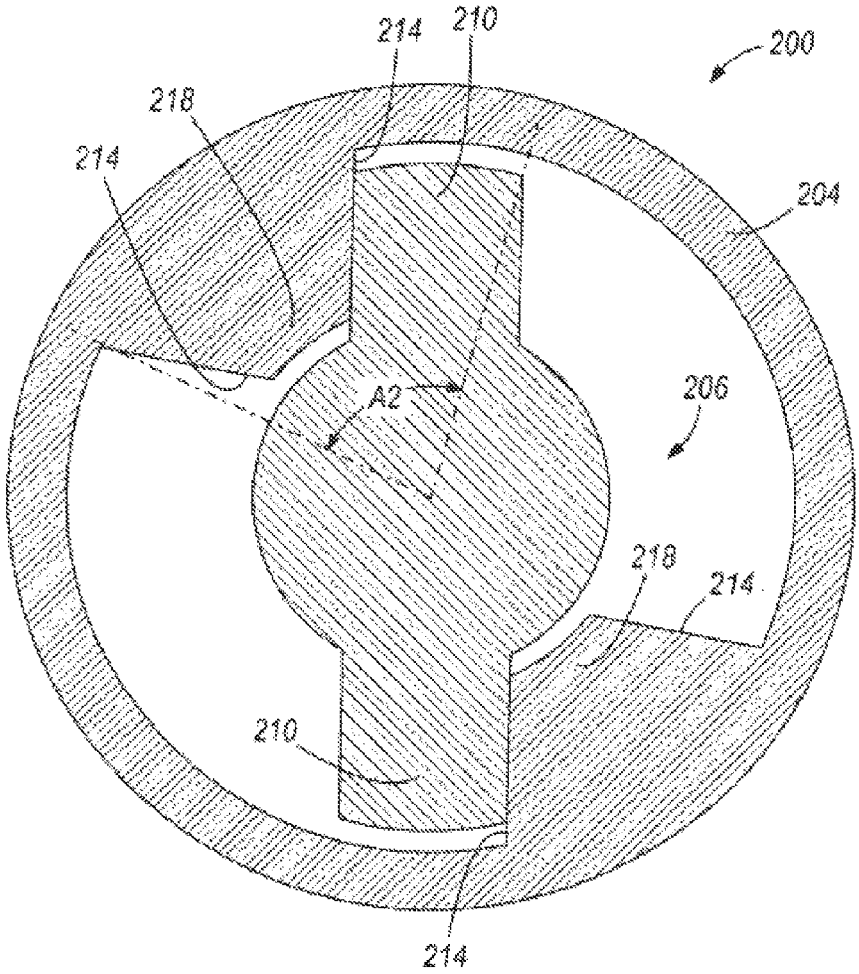
FIG. 5 (PRIOR ART)
FIG. 5 is an assembled, cross-sectional view of a prior-art drive assembly including an anvil with square lugs.

FIG. 5 illustrates a prior art drive assembly 200 including a ram 204 and an anvil 206. The anvil 206 includes squared lugs 210 that engage straight, inclined driven surfaces 214 of respective ram lugs 218. The timing angle A2, during which the ram lugs 218 are passing over the anvil lugs 210 as the ram 204 is retracted from the anvil 206, is about 80 degrees. Because the drive assembly 42 of the present invention provides a timing angle A1 that is substantially reduced from the timing angle A2 of prior-art drive assemblies (e.g., drive assembly 200), the drive assembly 42 of the present invention enhances the smoothness of operation of the impact wrench 10.

Various features of the invention are set forth in the following claims.

What is claimed is:

1. A drive assembly for an impact wrench, the impact wrench including a tool element for working on a workpiece, the drive assembly comprising:

a ram rotatable about a central axis, the ram including a ram lug spaced from the central axis, the ram lug having at least one drive surface; and an anvil including an anvil lug having at least one driven surface engageable with the drive surface of the ram lug to drive the anvil, the anvil connectable to the tool element to rotatably drive the tool element;

wherein each of the drive surface and the driven surface includes an involute profile.

2. The drive assembly of claim 1, wherein the drive surface of the ram lug is a first drive surface, and wherein the ram lug includes a distal end adjacent the first drive surface, and a second drive surface adjacent the distal end and opposite the first drive surface.

3. The drive assembly of claim 2, wherein each of the first and second drive surfaces includes an involute profile.

4. The drive assembly of claim 1, wherein the driven surface of the anvil lug is a first driven surface, and wherein the anvil lug includes a distal end adjacent the first driven surface, and a second driven surface adjacent the distal end and opposite the first driven surface.

5. The drive assembly of claim 4, wherein each of the first and second driven surfaces includes an involute profile.

6. The drive assembly of claim 4, wherein the drive surface of the ram lug is a first drive surface, wherein the ram lug includes a distal end adjacent the first drive surface, and a second drive surface adjacent the distal end and opposite the first drive surface, and further wherein each of the first and second drive surfaces includes an involute profile.

7. The drive assembly of claim 6, wherein the first drive surface of the ram lug engages the first driven surface of the anvil lug to drive the anvil in a first rotational direction, and wherein the second drive surface of the ram lug engages the second driven surface of the anvil lug to drive the anvil in a second rotational direction.

8. The drive assembly of claim 1, wherein the ram lug is a first ram lug, and wherein the ram further includes a second ram lug spaced from the central axis and positioned opposite the first ram lug.

9. The drive assembly of claim 1, wherein the anvil lug is a first anvil lug, and wherein the anvil further includes a second anvil lug spaced from the central axis and positioned opposite the first anvil lug.

10. The drive assembly of claim 9, wherein the ram lug is a first ram lug, wherein the ram further includes a second ram lug spaced from the central axis and positioned opposite the first ram lug, and wherein the first ram lug engages the first anvil lug at the same instant that the second ram lug engages the second anvil lug.

11. An impact wrench operable with a tool element for working on a workpiece, the impact wrench comprising:

a housing;

a motor supported by the housing;

a ram rotatable about a central axis in response to torque received from the motor, the ram including a ram lug spaced from the central axis, the ram lug having at least one drive surface; and an anvil including an anvil lug having at least one driven surface engageable with the drive surface of the ram lug to drive the anvil, the anvil connectable to the tool element to rotatably drive the tool element;

wherein each of the drive surface and the driven surface includes an involute profile.

12. The impact wrench of claim 11, wherein the drive surface of the ram lug is a first drive surface, and wherein the ram lug includes a distal end adjacent the first drive surface, and a second drive surface adjacent the distal end and opposite the first drive surface.

13. The impact wrench of claim 12, wherein each of the first and second drive surfaces includes an involute profile.

14. The impact wrench of claim 11, wherein the driven surface of the anvil lug is a first driven surface, and wherein the anvil lug includes a distal end adjacent the first driven surface, and a second driven surface adjacent the distal end and opposite the first driven surface.

15. The impact wrench of claim 14, wherein each of the first and second driven surfaces includes an involute profile.

16. The impact wrench of claim 14, wherein the drive surface of the ram lug is a first drive surface, wherein the ram lug includes a distal end adjacent the first drive surface, and a second drive surface adjacent the distal end and opposite the first drive surface, and further wherein each of the first and second drive surfaces includes an involute profile.

17. The impact wrench of claim 16, wherein the first drive surface of the ram lug engages the first driven surface of the anvil lug to drive the anvil in a first rotational direction, and wherein the second drive surface of the ram lug engages the second driven surface of the anvil lug to drive the anvil in a second rotational direction.

18. The impact wrench of claim 11, wherein the ram lug is a first ram lug, and wherein the ram further includes a second ram lug spaced from the central axis and positioned opposite the first ram lug.

19. The impact wrench of claim 11, wherein the anvil lug is a first anvil lug, and wherein the anvil further includes a second anvil lug spaced from the central axis and positioned opposite the first anvil lug.

20. The impact wrench of claim 19, wherein the ram lug is a first ram lug, wherein the ram further includes a second ram lug spaced from the central axis and positioned opposite the first ram lug, and wherein the first ram lug engages the first anvil lug at the same instant that the second ram lug engages the second anvil lug.

* * * * *

UNITED STATES PATENT AND TRADEMARK OFFICE

CERTIFICATE OF CORRECTION

PATENT NO. : 8,505,648 B2
APPLICATION NO. : 12/991182
DATED : August 13, 2013
INVENTOR(S) : William A. Elger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 389 days.

Signed and Sealed this
Fifteenth Day of September, 2015

Michelle K. Lee

Michelle K. Lee
*Director of the United States Patent and Trademark Office*